US006369492B1

(12) United States Patent
Sugimoto

(10) Patent No.: US 6,369,492 B1
(45) Date of Patent: Apr. 9, 2002

(54) LIGHTING UNIT WITH REFLECTING MIRROR

(75) Inventor: Hiroshi Sugimoto, Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/236,983

(22) Filed: Jan. 26, 1999

(30) Foreign Application Priority Data

Apr. 15, 1998 (JP) ..... 10-104465

(51) Int. Cl.[7] ..... H01J 5/16; H01J 61/40; H01K 1/26; H01K 1/30; F21V 7/00

(52) U.S. Cl. ..... 313/113; 313/114; 313/116; 362/346; 362/347; 362/297

(58) Field of Search ..... 313/113, 114, 313/116; 362/346–350, 296, 297; 348/786; 359/614

(56) References Cited

U.S. PATENT DOCUMENTS

| | | | | |
|---|---|---|---|---|
| 1,590,130 A | * | 6/1926 | Sturgeon, Jr. | 362/348 |
| 4,864,476 A | * | 9/1989 | Lemons et al. | 362/297 |
| 5,144,190 A | * | 9/1992 | Thomas et al. | 313/113 |
| 5,272,408 A | | 12/1993 | Levin et al. | 313/113 |
| 5,442,252 A | * | 8/1995 | Golz | 313/113 |
| 5,483,424 A | | 1/1996 | Lightbody | 362/17 |
| 5,568,967 A | | 10/1996 | Sikkens et al. | 362/328 |
| 6,086,224 A | * | 6/2000 | Sugimoto | 313/113 |
| 6,086,227 A | * | 7/2000 | O'Connell et al. | 362/297 |
| 6,102,555 A | | 8/2000 | Mizoguchi | 362/347 |

FOREIGN PATENT DOCUMENTS

| | | |
|---|---|---|
| EP | 0 136 684 A2 | 4/1985 |
| EP | 0 250 191 A2 | 12/1987 |
| JP | 05021043 | 1/1993 |

OTHER PUBLICATIONS

European Search Report dated Mar. 6, 2001, 4 pages.

* cited by examiner

*Primary Examiner*—Nimeshkumar D. Patel
*Assistant Examiner*—Mariceli Santiago
(74) *Attorney, Agent, or Firm*—Rosenthal & Osha L.L.P.

(57) ABSTRACT

A lighting unit with a reflecting mirror to prevent irradiation nonuniformity on an irradiated surface, produced by arranging a bulb as a light source in a funnel-shaped reflecting mirror having a reflecting surface and by arranging a plurality of fine reflecting surfaces on the reflecting surface non-radially and non-concentrically without clearance. Preferably the fine reflecting surfaces appear to be a honeycomb, and are formed substantially the same size of 0.01–5 mm long, 0.01–5 mm wide.

10 Claims, 6 Drawing Sheets

LIGHTING UNIT WITH REFLECTING MIRROR

FIELD OF THE INVENTION

This invention relates to a lighting unit with a reflecting mirror used for lighting up goods at stores or the like, i.e., a lighting unit having a bulb with a reflecting mirror.

BACKGROUND OF THE INVENTION

A conventional lighting unit with a dichroic reflecting mirror is disclosed in U.S. Pat. No. 5,272,408. The lighting unit is produced by combining a funnel-shaped reflecting mirror which has a reflecting mirror surface provided with a dichroic film, as a light interference film and a bulb, such as a tungsten halogen lamp. Such lighting units with dichroic reflecting mirrors are used for lighting goods at stores or the like. As shown in FIG. 4, such a lighting unit with a reflecting mirror includes a funnel-shaped reflecting mirror 23 having a reflecting part 25 and a neck portion 26, and, as a light source, a bulb, such as a straight tungsten halogen lamp 21, provided inside the reflecting mirror 23. A tungsten filament 30 is provided within the tungsten halogen lamp 23. The reflecting part 25 has a reflecting surface provided with a dichroic film 24, while the neck portion 26 is connected with the reflecting part 23. The tungsten halogen lamp 21 is inserted and sealed into a base 28 at the upper position.

The tungsten halogen lamp 21 is substantially coaxially located inside the reflecting mirror 23. The neck portion 26 of the reflecting mirror 23 and the sealing portion 22 of the tungsten halogen lamp 21 are inserted into the base 28 and combined into one component by injecting an inorganic adhesive 29 into the base 28.

In the conventional lighting unit with a reflecting mirror, it is desired that as much of the light and dark image of the coiled tungsten filament 30 contained in the tungsten halogen lamp 21 as possible is prevented from being seen on the irradiated surface during lighting, so that the illuminance of the irradiated surface will be uniform and any irradiation nonuniformity on the irradiated surface can be avoided. For this purpose, fine reflecting surfaces 25*a* (FIG. 5) are formed on the reflecting surface of the reflecting part 25 in order to scatter the reflected light appropriately. More specifically, hexagonal fine reflecting surfaces 25*a* are radially arrayed in good order without leaving clearance, and the fine reflecting surfaces become smaller gradually from the opening part 27 of the reflecting mirror 23 toward the neck portion 26.

In the conventional tungsten halogen lamp with a reflecting mirror, hexagonal fine reflecting surfaces 25*a* are formed without clearance. As a result, concave or convex boundary lines 25*b* are formed at the borders of adjacent fine reflecting surfaces 25*a* in radial lines from the opening part 27 of the reflecting mirror 23 to the neck portion 26. Light that falls on the boundary will not be scattered, and thus, irradiation nonuniformity, such as radial lines, occurs on the irradiated surface.

As shown in FIG. 6, the luminous intensity distribution of the conventional tungsten halogen lamp with a reflecting mirror has irregularities in the curve before the light intensity comes to the peak. The irregularities indicate the radial linear difference between the bright parts and dark parts, which causes nonuniformity in irradiation.

SUMMARY OF THE INVENTION

In order to solve the problems of the conventional units, this invention aims to provide a lighting unit with a reflecting mirror that can prevent irradiation nonuniformity on the irradiated surface.

To achieve the aims, a lighting unit with a reflecting mirror of this invention includes a bulb as a light source, arranged inside a funnel-shaped reflecting mirror having a reflecting surface, and a plurality of fine reflecting planes that are arranged on the reflecting surface non-centrally originating and non-radially without clearance.

It is preferable in the lighting unit with a reflecting mirror that the shapes of the fine reflecting surfaces are at least one shape selected from the group consisting of a circle, an ellipse, and a polygon.

It is preferable in the lighting unit with a reflecting mirror that the fine reflecting surfaces are concave or convex.

It is also preferable in the lighting unit with a reflecting mirror that the surface of each fine reflecting surface is dented or protruded in the range of 0.01 to 1.0 mm.

It is also preferable in the lighting unit with a reflecting mirror that a dichroic film is provided on at least one wall surface of the reflecting mirror. Here, a dichroic film refers to a light interference film formed by alternately laminating a high-refractive layer including zinc sulphide (ZnS) and a low-refractive layer including magnesium fluoride. The film radiates a visible light emitted from the light source on the front surface of the mirror, and selectively lets an infrared ray go to the back of the mirror.

It is also preferable in the lighting unit with a reflecting mirror that the size of the fine reflecting surfaces on the entire reflecting surface is not varied substantially. The term 'not varied substantially' means that slight differences due to manufacturing processes is permissible.

It is also preferable in the lighting unit with a reflecting mirror that the luminous intensity curve is smooth when the beam angle just beneath the light source is 0° and the beam angle at the neck portion of the same light source is 90°. When the curve of the luminous intensity distribution is smooth before it comes to a peak and has no irregularities, the brightness is not varied in radial lines and there is no irradiation nonuniformity.

It is also preferable in the lighting unit with a reflecting mirror that the appearance of the fine reflecting surfaces is a honeycomb, so that the fine reflecting surfaces can be formed without clearance.

It is also preferable in the lighting unit with a reflecting mirror that the size of the fine reflecting surfaces ranges from 0.01 to 5 mm long, and from 0.01 to 5 mm wide.

It is also preferable in the lighting unit with a reflecting mirror that the bulb as a light source is at least one selected from the group consisting of a tungsten halogen lamp and a discharge lamp.

DETAILED DESCRIPTION OF THE INVENTION

Figure 1:
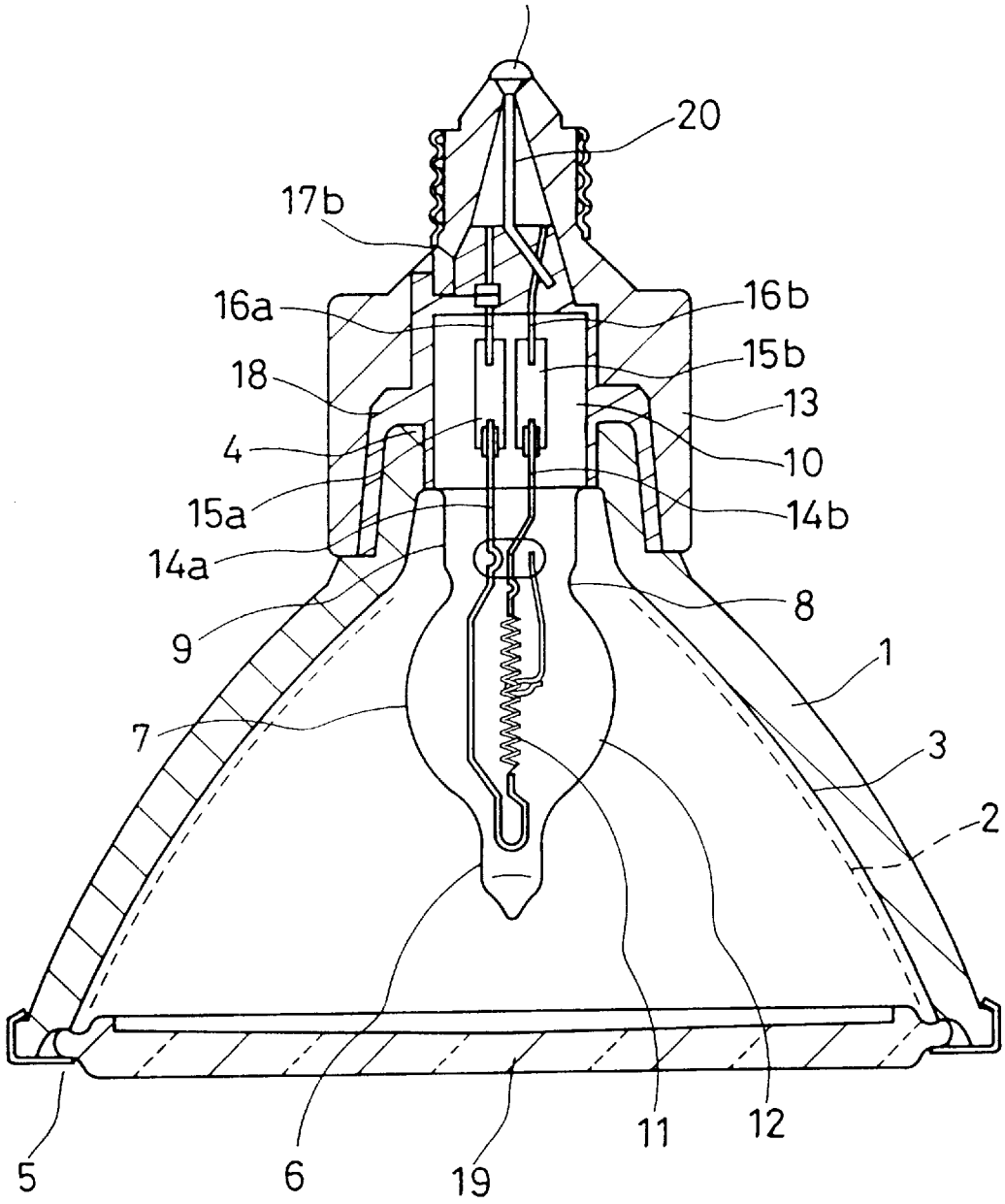
FIG. 1 is a partially broken front view showing a bulb with a reflecting mirror in one embodiment of this invention.

FIG. 1 shows a lighting unit with a reflecting mirror in accordance with one embodiment of this invention. The lighting unit includes a funnel-shaped reflecting mirror 1 made from borosilicate glass, a tungsten halogen lamp 12 containing a predetermined volume of halogenated compound and an inert gas, and a base 13 including zircon cordierite. The reflecting mirror 1 is provided with an opening part 5 including a reflecting part 3 and a neck portion 4 connected to the reflecting part 3. The reflecting part 3 has a reflecting surface on which a light interference film, e.g., dichroic film 2, is coated. In the tungsten halogen lamp 12, a closed part 6, a spheroid swelling part 7, a narrowed-down portion 8, a cylindrical part 9, a sealing portion 10 are provided sequentially. A coiled tungsten filament 11 is provided inside the swelling part 7.

The sealing portion 10 of the tungsten halogen lamp 12 is inserted substantially coaxially in the neck portion 4 of the reflecting mirror 1. Furthermore, the sealing portion 10 of the tungsten halogen lamp 12 and the neck portion 4 of the reflecting mirror 1 are inserted in the base 13 and combined with the base 13 by a heat-resistant inorganic adhesive 18, such as an inorganic adhesive including silica and alumina as main components.

At the sealing portion 10 of the tungsten halogen lamp 12, a connector including metal foils (15*a*, 15*b*), inner lead wires (14*a*, 14*b*) and outer lead wires (16*a*, 16*b*) is sealed. Each inner lead wire is connected to one end of each metal foil, and each outer lead wire is connected to the other end of the same metal foil.

The ends of the inner lead wires (14*a*, 14*b*) that are not connected to the metal foils (16*a*, 15*b*) are introduced respectively into the tungsten halogen lamp 12 in order to hold both ends of the tungsten filament 11. The ends of the outer lead wire (16*a*, 16*b*) that are not connected to the metal foils (15*a*, 15*b*) are introduced respectively from the sealed portion 10 to the outside of the tungsten halogen lamp 12. The outer lead wires (16*a*, 16*b*) are connected to power supply parts (17*a*, 17*b*) of the base 13 respectively. The power supply part 17*a* and the outer lead wire 16*b* are connected by a lead wire 20. A front glass 19 is provided to the opening part 5 of the reflecting mirror 1.

Figure 2:
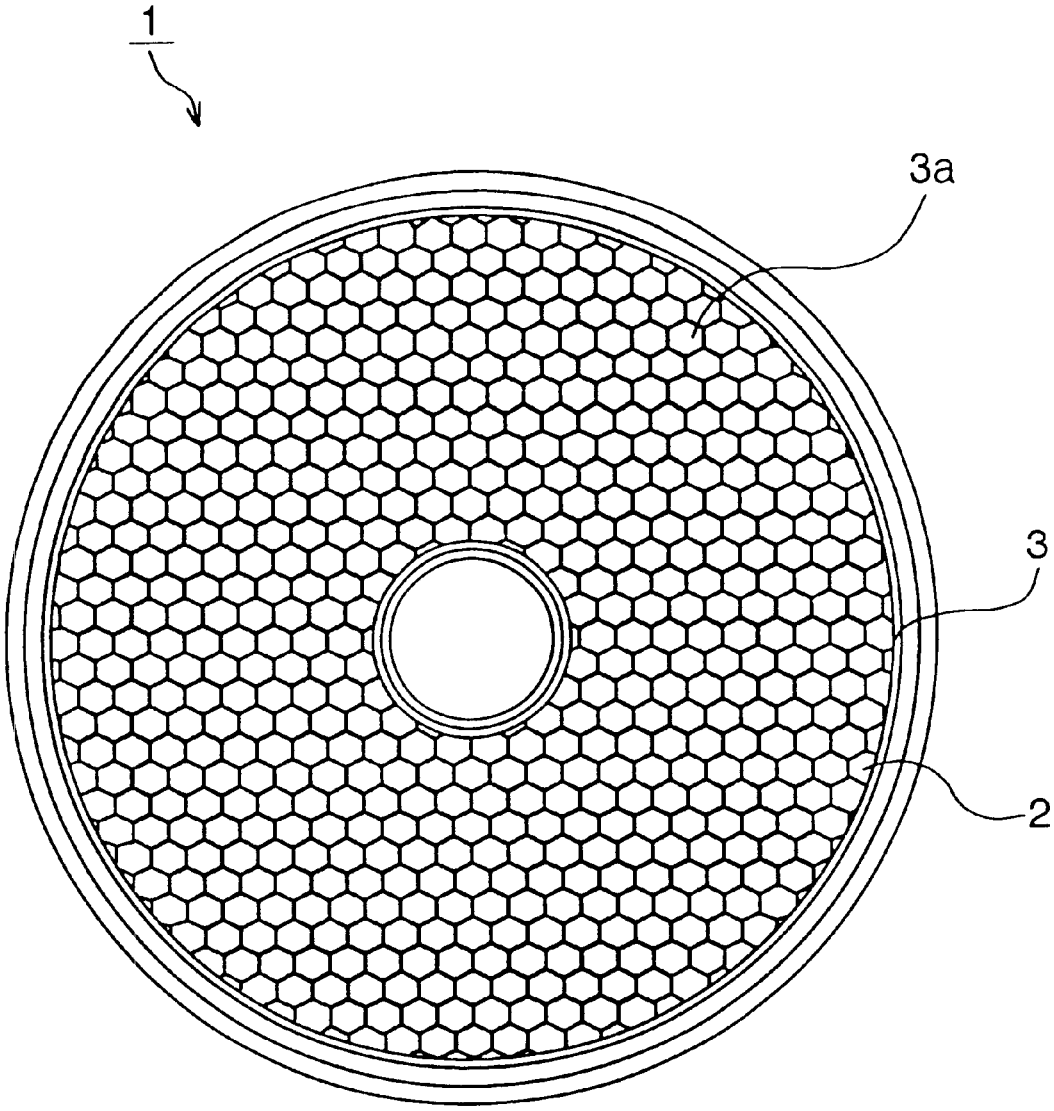
FIG. 2 is an explanatory view of a reflecting part of the reflecting mirror.

As shown in FIG. 2, the reflecting mirror 1 is formed by arranging a plurality of overlapping fine reflecting planes 3*a* non-centrally originating and non-radially without clearance on the reflecting surface of the reflecting part 3. The honeycombed fine reflecting planes are convex with a height of 0.3 mm (length of one side: 1.5 mm, length: 3 mm, and width: 2.6 mm) and the size does not vary substantially.

The fine reflecting surfaces 3*a* are formed by preparing a mold of the fine reflecting surfaces suitable for use with molding a borosilicate glass reflecting mirror 1, and by pouring borosilicate glass into the mold. After annealing and cooling, a high-refractive layer including zinc sulphide (ZnS) and a low-refractive layer including magnesium fluoride are laminated alternately to form a light interference film (a dichroic reflecting film).

In the tungsten halogen lamp with a dichroic reflecting mirror according to the embodiment of this invention (hereinafter, referred to as "invented item"), the outer diameter of the reflecting mirror opening part is 70 mm, and the rated voltage is 110V. The electricity is 65 W, the central luminous intensity is 4500 cd, and the beam angle is 22 degrees.

An irradiation test was carried out for the invented item. The result showed that irradiation nonuniformity was not found on the irradiated surface and a uniform luminous intensity distribution was obtained. The reason for this result is that light radiated from the tungsten halogen lamp 12 was properly scattered since a plurality of convex fine reflecting plane 3*a* were formed and arranged non-centrally-originating and non-radially without clearance.

Figure 3:
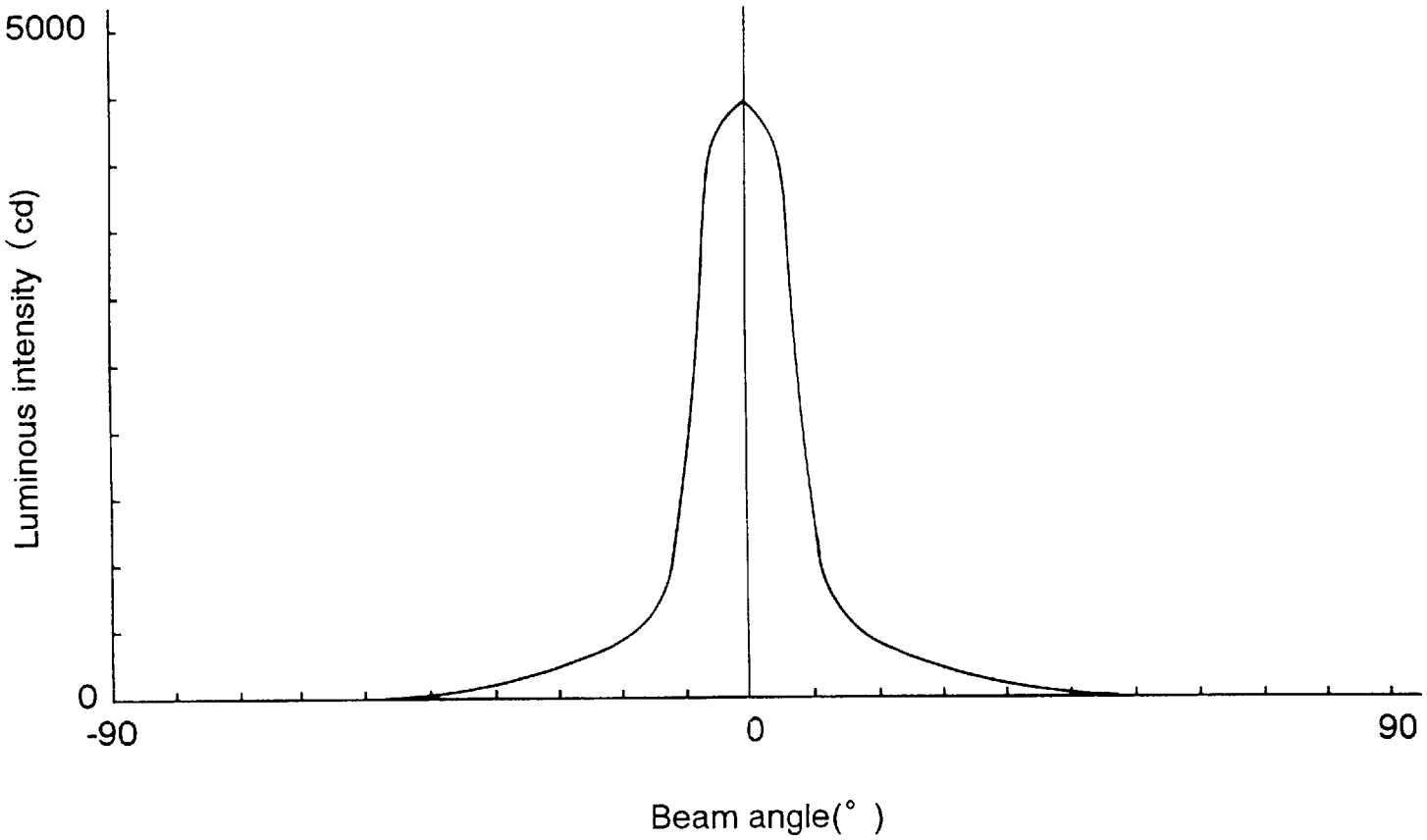
FIG. 3 is a graph showing a luminous intensity distribution according to this invention.
Figure 4:
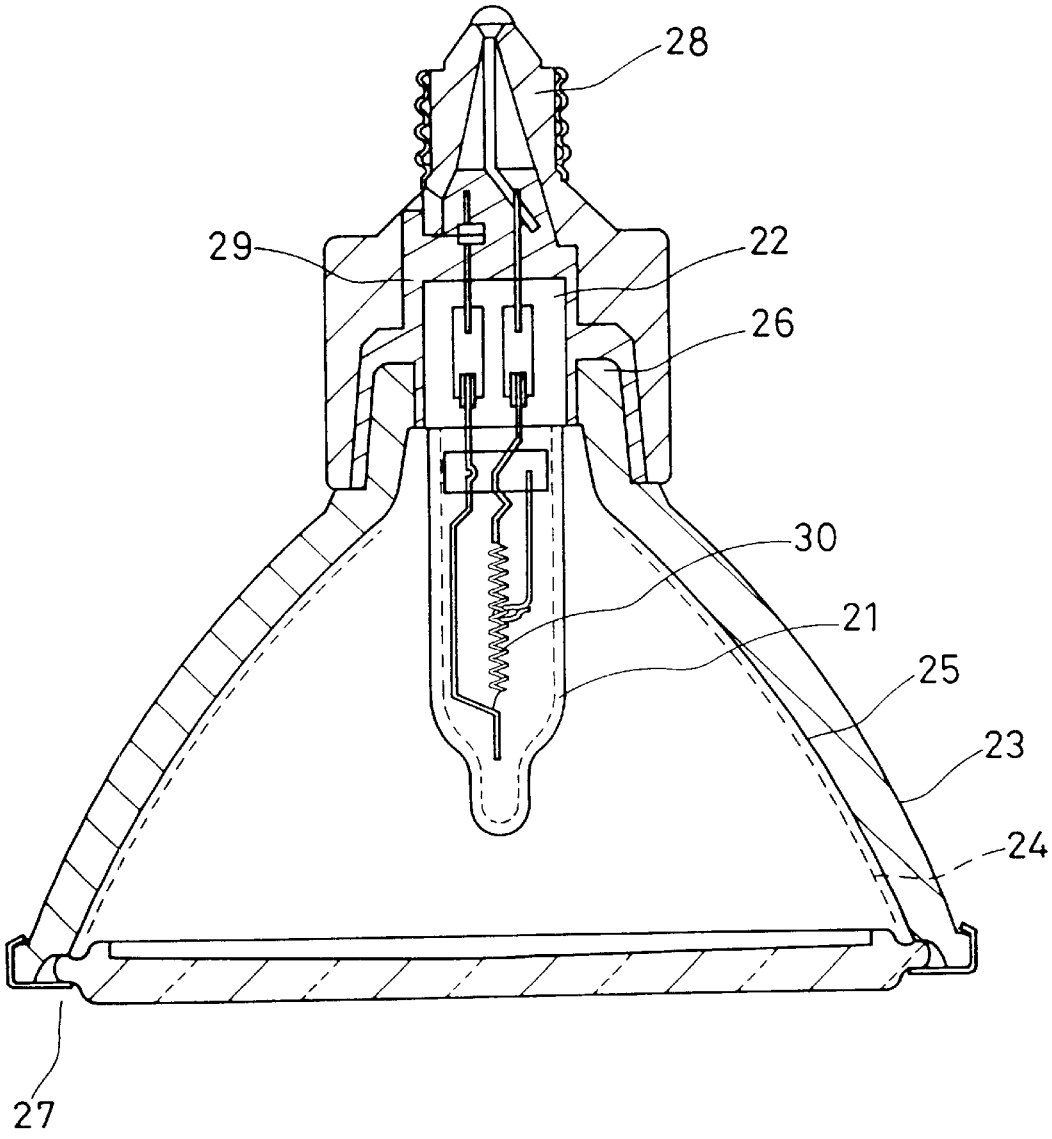
FIG. 4 (PRIOR ART)
FIG. 4 is a partially broken front view showing a conventional bulb with a reflecting mirror.
Figure 5B:
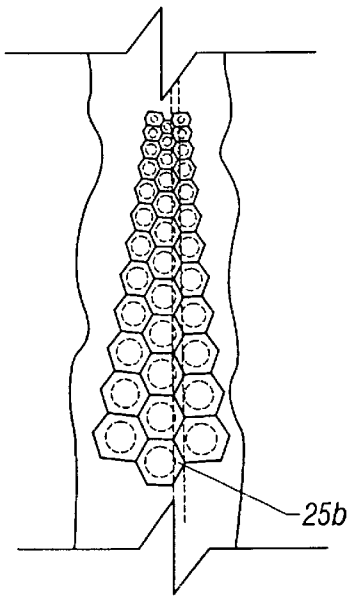
FIG. 5B (Prior Art)
FIG. 5 is an explanatory view of a reflecting part of the reflecting mirror shown in FIG. 4.
Figure 5A:
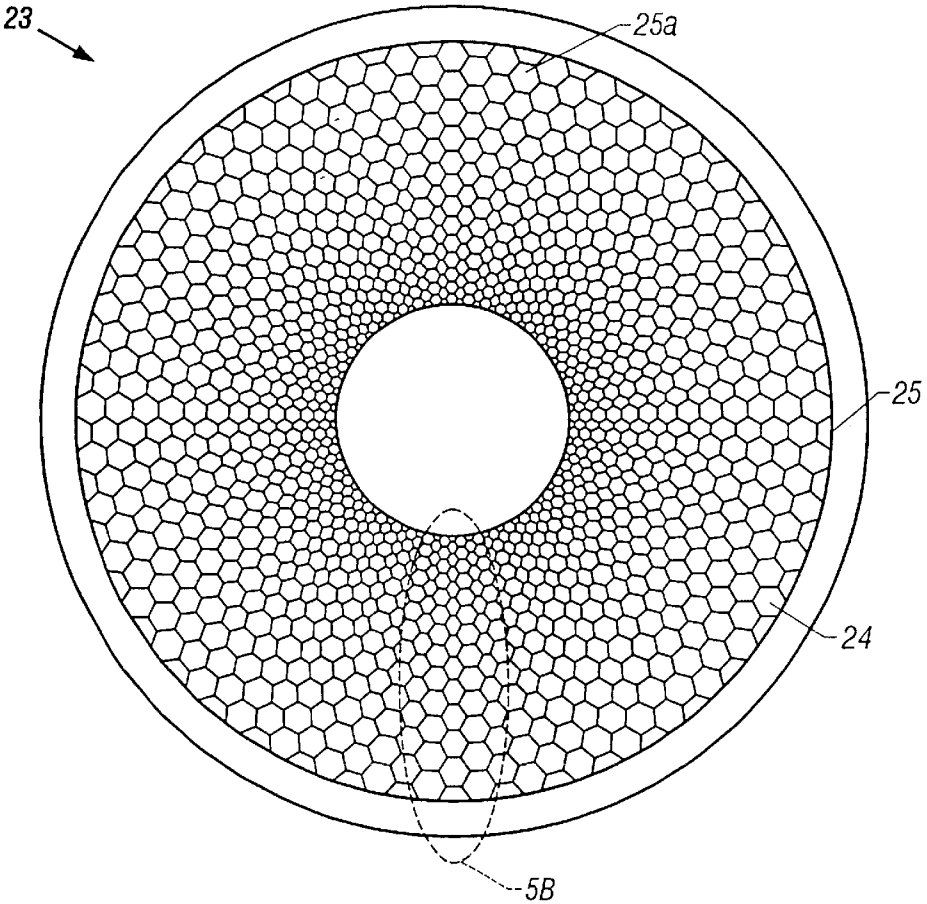
FIG. 5A (Prior Art)
Figure 6:
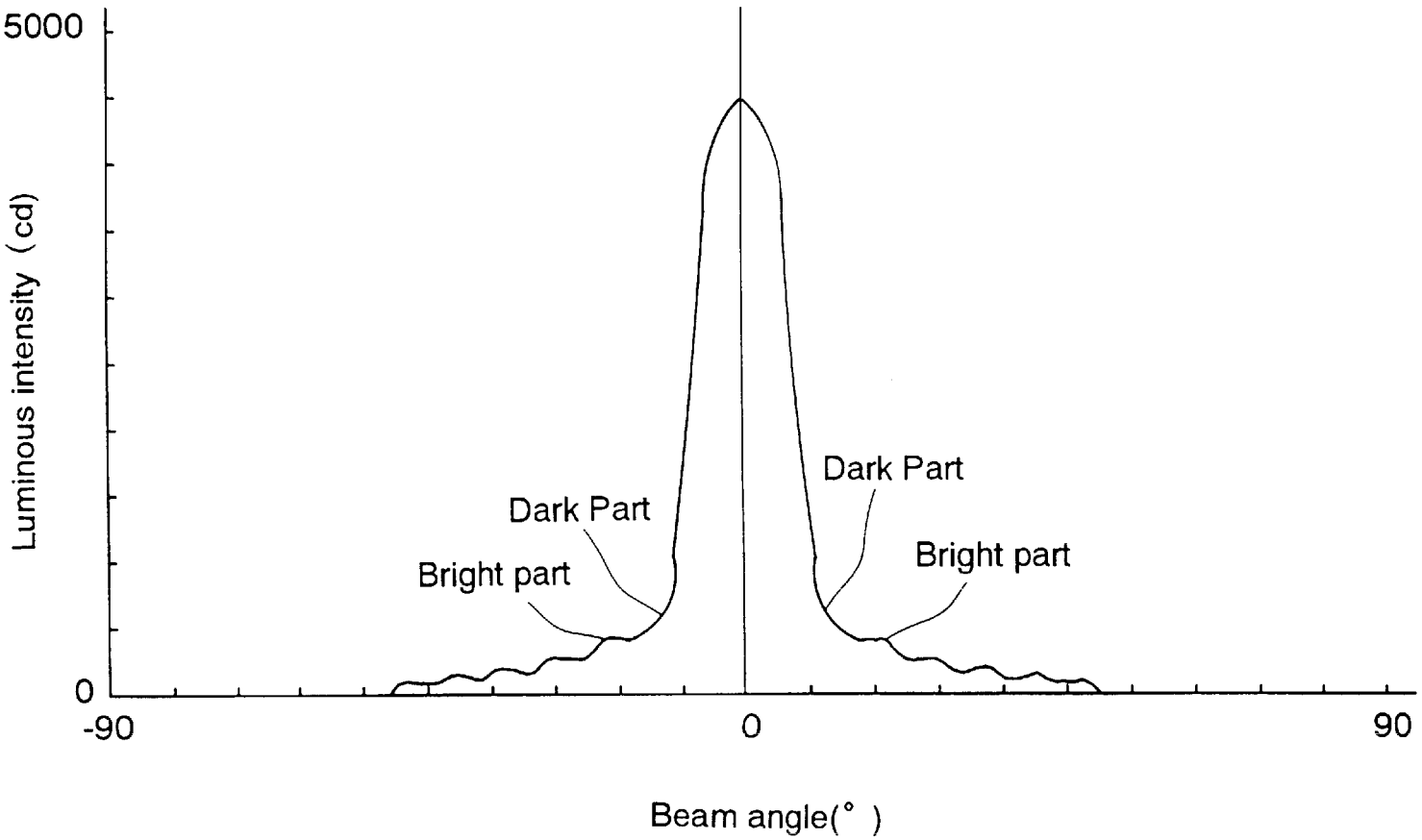
FIG. 6 (PRIOR ART)
FIG. 6 is a graph showing a luminous intensity distribution according to the conventional technique.

FIG. 3 shows the luminous intensity curve of the invented item, while FIG. 6 shows the luminous intensity distribution of the conventional tungsten halogen lamp with a reflecting mirror (hereinafter, referred to as "conventional item").

As clearly shown in FIG. 3, the luminous intensity curve of the luminous distribution from the opening part 5 to the neck portion 4 of the reflecting mirror 1 of the invented lamp is smooth when the beam angle just beneath the light source is 0° and the beam angle at the neck portion of the light source is 90°. The smooth curve indicates that a beautiful luminous distribution free from irradiation nonuniformity can be obtained.

The shape of a fine reflecting surface 3*a* can be a circle, an ellipse, or a polygon, and it can be shaped to be concave or convex.

Although a tungsten halogen lamp was used as the light source in this embodiment, similar effects can be obtained by using a discharge lamp.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A lighting unit with a reflecting mirror, the lighting unit comprising:

a bulb as a light source arranged in a funnel-shaped reflecting mirror having a reflecting surface, wherein a plurality of substantially uniform in size fine reflecting surfaces are arranged non-centrally originating and non-radially without clearance on the reflecting surface.

2. The lighting unit with a reflecting mirror according to claim 1, wherein a shape of the fine reflecting surfaces is at least one shape selected from the group consisting of circular, elliptical, and polygonal.

3. The lighting unit with a reflecting mirror according to claim 1, wherein a shape of the fine reflecting surfaces is at least one shape selected from the group consisting of concave and convex.

4. The lighting unit with a reflecting mirror according to claim 3, wherein a range of convex and concave is from 0.01 to 1.0 mm.

5. The lighting unit with a reflecting mirror according to claim 1, wherein a dichroic film is formed on at least one side of a wall surface of the reflecting mirror.

6. The lighting unit with a reflecting mirror according to claim 1, wherein the fine reflecting surfaces on the reflecting surface are substantially uniform in dimension.

7. The lighting unit with a reflecting mirror according to claim 1, wherein a luminous intensity curve is smooth when a beam angle just beneath the light source is 0° and a beam angle at a neck portion of the light source is 90°.

8. The lighting unit with a reflecting mirror according to claim 1, wherein the fine reflecting surfaces appear to be a honeycomb.

9. The lighting unit with a reflecting mirror according to claim 1, wherein a dimension of the fine reflecting surfaces is from 0.01 to 5 mm long and 0.01 to 5 mm wide.

10. The lighting unit with a reflecting mirror according to claim 1, wherein the bulb as a light source is at least one lamp selected from the group consisting of a tungsten halogen lamp and a discharge lamp.

* * * * *

UNITED STATES PATENT AND TRADEMARK OFFICE

CERTIFICATE OF CORRECTION

PATENT NO. : 6,369,492 B1
DATED : April 9, 2002
INVENTOR(S) : Hiroshi Sugimoto

It is certified that error appears in the above-identified patent and that said Letters Patent is hereby corrected as shown below:

Title page, Item [54] and Column 1, lines 1-2,
Please change "LIGHTING UNIT WITH REFLECTING MIRROR" to
-- LIGHTING UNIT WITH REFLECTING MIRROR HAVING NON-CENTRALLY ORIGINATING AND NON-RADIALLY ARRANGED FINE REFLECTING PLANES --.

Item [57], ABSTRACT,
Line 6, please remove the words "and non-concentrically".

Signed and Sealed this

Third Day of September, 2002

*Attest:*

*Attesting Officer*

JAMES E. ROGAN
*Director of the United States Patent and Trademark Office*